US007051774B2

(12) United States Patent
De Baan

(10) Patent No.: US 7,051,774 B2
(45) Date of Patent: May 30, 2006

(54) MOORING SYSTEM FOR FLUID CARGO TANKERS

(75) Inventor: Jaap De Baan, Maassluis (NL)

(73) Assignee: Bluewater Offshore Production, Hoofddorp (NL)

( * ) Notice: Subject to any disclaimer, the term of this patent is extended or adjusted under 35 U.S.C. 154(b) by 165 days.

(21) Appl. No.: 10/757,729

(22) Filed: Jan. 14, 2004

(65) Prior Publication Data

US 2004/0154698 A1 Aug. 12, 2004

Related U.S. Application Data

(60) Provisional application No. 60/441,069, filed on Jan. 17, 2003.

(51) Int. Cl.
*B65B 1/04* (2006.01)

(52) U.S. Cl. ..... 141/279; 141/2; 141/388; 441/4

(58) Field of Classification Search ..... 141/1, 141/2, 18, 279, 387, 388; 441/3–5; 114/230.14, 114/230.1, 230.25; 137/615, 236.1
See application file for complete search history.

(56) References Cited

U.S. PATENT DOCUMENTS 4,031,582 A * 6/1977 Van Heijst ..... 441/3
4,317,474 A * 3/1982 Kentosh ..... 141/1
4,606,294 A * 8/1986 Di Tella et al. ..... 114/230.14

* cited by examiner

*Primary Examiner*—Timothy L. Maust
(74) *Attorney, Agent, or Firm*—Alan R. Thiele

(57) ABSTRACT

The liquid cargo mooring and fluid transfer system of the present invention includes a first column affixed to the ocean floor. The first column supports one end of an extended length space frame. At the opposite end of the space frame is a buoyant support. The buoyant support includes a flat tank and a buoyant column. Fluid transfer equipment is attached to the column portion of the buoyant support on the second end of the space frame.

5 Claims, 3 Drawing Sheets

MOORING SYSTEM FOR FLUID CARGO TANKERS

REFERENCE TO RELATED APPLICATION

This application claims priority from U.S. Provisional Patent Application Ser. No. 60/441,069 filed Jan. 17, 2003.

BACKGROUND OF THE INVENTION

1. Field

The present invention pertains to the transportation of fluid cargo; more particularly, the present invention pertains to a mooring and fluid transfer system to be used with ocean-going liquid cargo transport vessels.

2. Background

Many fluid cargo tankers, particularly those carrying a volatile cargo of liquids, gases, or a combination thereof, are offloaded in protected locations. Accordingly, LNG tankers are typically moored alongside a special quay. This special quay is located in a protected location where damage, in the event of an explosion, would be minimized.

From both an efficiency and safety standpoint, it would be desirable to offload fluid cargo tankers, particularly LNG tankers, offshore. However, the key disadvantage to offshore offloading is the fact that weather and wave conditions cause the LNG tanker vessels to be in a continuous state of motion. Hence, it is difficult for loading arms, even articulated loading arms, to cope with the continuous motion of a tanker moored offshore. Accordingly, a need remains in the art for a mooring and transfer system that can be used with fluid cargo tankers at an offshore location.

SUMMARY

One object of the present invention is to provide a mooring system for fluid cargo tankers which acts as an "offshore quay," about which a fluid cargo tanker can moor in such a fashion that single point mooring technology, such as described in U.S. Pat. No. 5,584,607, to the same assignee, can be applied. The disclosed mooring system can be fitted with the same type of conventional steel loading arms and flexible hose connections used at onshore facilities.

The mooring and transfer system of the present invention for use with oceangoing fluid cargo vessels includes an extended length space frame. The extended length space frame is supported by a first column secured to the ocean floor on one end and a second buoyant column located on the opposite end of the extended length space frame. The second buoyant column is supported by a substantially flat buoyant tank. A system for mooring the vessel is located at the end of the rigid space frame supported by the first column. A system for changing the direction and/or orientation of the rigid length space frame is located near the second buoyant column. The transfer of liquid cargo from the vessel is accomplished at the end of the space frame near the second buoyant column.

BRIEF DESCRIPTION OF THE DRAWING FIGURES

A still better understanding of the mooring and transfer system for use with liquid cargo vessels may be had by reference to the drawing figures, wherein.

DESCRIPTION OF THE EMBODIMENTS

Figure 1:
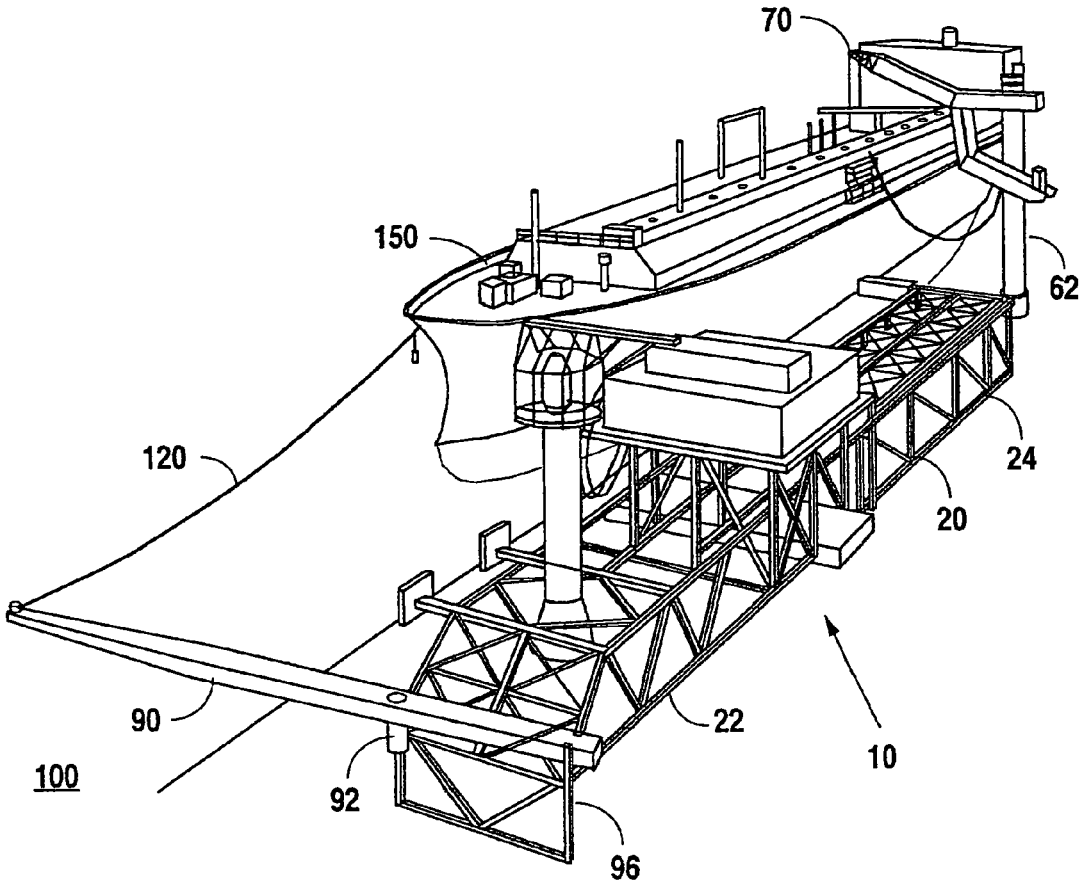
FIG. 1 is a left front perspective view of the system of the present invention.
Figure 2:
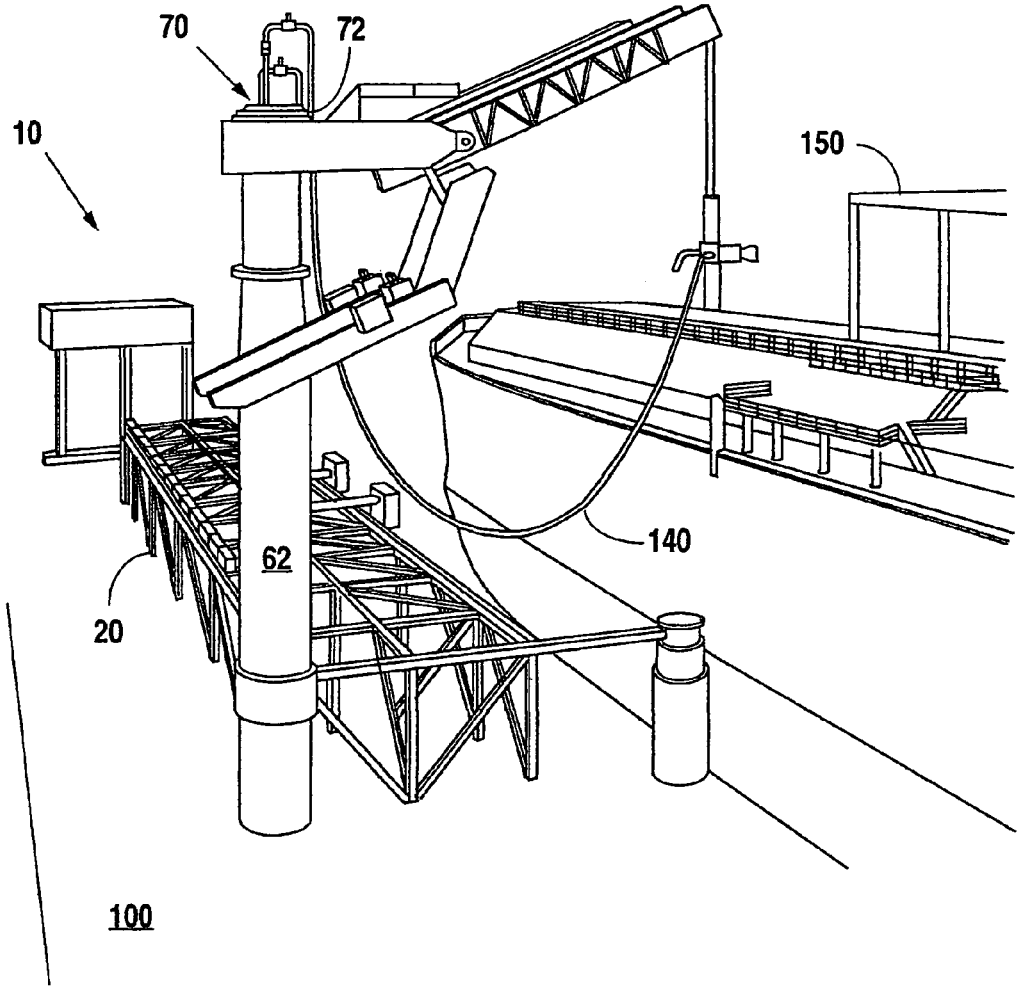
FIG. 2 is a left rear perspective view.
Figure 3A:
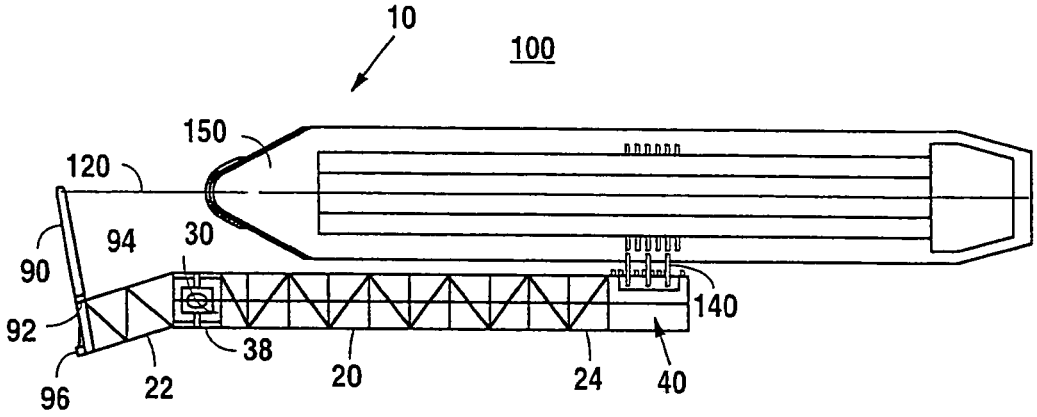
FIG. 3A is a top plan view of the system shown in FIG. 1.
Figure 3B:
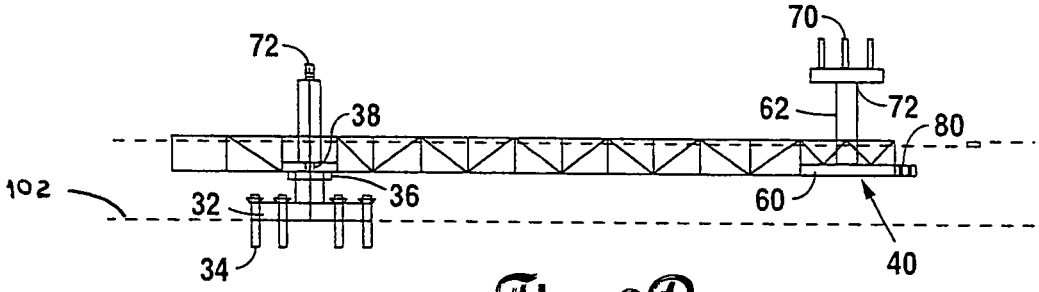
FIG. 3B is a side elevational view.
Figure 3C:
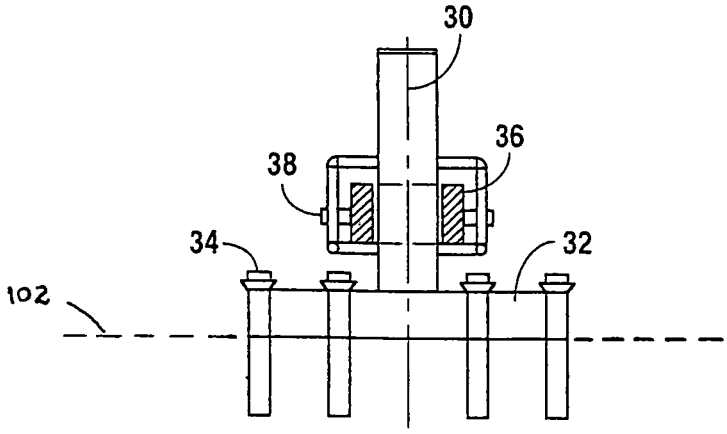
FIG. 3C is a left side elevational view.

In its preferred embodiment, the mooring and fluid transfer system 10 of the present invention is configured as shown in the drawing figures:

A rigid space frame 20 is supported on its first end 22 in a shallow depth body of water 100, generally less than 30 meters deep, by a first seabed supported column 30 and on its second end 24 by a buoyancy system 40. As shown in FIG. 3C, the first column 30 includes a generally large diameter steel base plate 32. The steel base plate 32 is secured to the seabed by a plurality of piles 34.

The first column 30 is fitted with a rotating collar 36. The rotating collar 36 is pivotally attached to the rigid space frame 20 by a hinge arrangement 38. The operating axis of the hinge arrangement 38 is located transverse to the longitudinal direction of the rigid space frame 20.

The buoyancy system 40, located on the opposite end of the rigid space frame 20 from the first column 30, is configured as a relatively "flat" tank 60 in the preferred embodiment, such that a large area is exposed to wave action. The flat shape of the tank 60 gives it the appearance of a "plate" running parallel to the seabed.

The volume and buoyancy of the tank 60 provides support for approximately half the weight rigid space frame 20, together with all of the fluid transfer and orientation equipment to be placed thereon. A column 62 rises substantially vertically from the tank 60 through the water surface. Column 62 is also buoyant.

The combination of the flat horizontal tank 60 and the buoyant column 62, which has a small waterline area, is that under the action of wind and waves, the resulting vertical motion of the rigid space frame 20, at its free end, is very small. This small vertical motion of the rigid space frame 20 is due to a low restoring stiffness provided by the small waterline area of the column 62 and a large entrapped mass provided by the flat horizontal tank 60.

The equipment 70 used to offload liquid cargo from a vessel 150 is placed on top of the column 62.

The rigid space frame 20 may also be fitted with thrusters 80 at its free end. The thrusters 80 enable the entire assembly to orient itself directionally about column 30. Those of ordinary skill in the art will understand that the space frame assembly 20 will align itself with the waves, current and wind such that a vessel transporting liquid cargo, wishing to moor alongside the space frame 20, can do so against the prevailing environment and still be fully stable and steerable.

To facilitate the use of a single point mooring system 120, rather than tying up using multiple mooring lines, a mooring pole 90 may be introduced. This mooring pole 90 is fitted in a semi-rigid manner to the rigid space frame 20, preferably at a location just forward of the column 30 and extending laterally from the rigid space frame 20 over half the width of the vessel. The mooring pole 90 is attached 92 in a rotatable manner to the rigid space frame 20 and extends the width of the space frame 20 to engage a stopper 96 which prevents the mooring pole 90 from moving under loads exerted by the vessel 150. If the vessel 150 were to ride up and overshoot its position along the rigid space frame 20, the mooring pole 90 is able to rotate forward around connection 92 and hence no obstacle or hazard would be presented to the vessel 150.

Generally used, the disclosed system includes the following method steps:

The extended length space frame 20 is angularly positioned along a preferred azimuth with respect to column by means of its thrusters 80.

The vessel 150 moors to the mooring pole 90 by a single hawser 120.

The thrusters 80 are activated as needed to maintain a preset determined separation distance between the side of the vessel 150 and the space frame 20. Alternatively, the thrusters 80 may cause the space frame 20 to exert a very slight push against the side of the vessel 150.

The fluid transfer connection between the loading equipment 70 on the top of the column 62 and the vessel 150 is made up.

The liquid cargo is then pumped from the vessel 150 through flowlines 140 incorporated in the space frame 20 through a swivel assembly 72 on top of the column 62, and then through flowlines connected to pipelines resting on the seabed which lead to an onshore location.

This disclosed system and method is particularly suited to the conveyance of cryogenic fluids such as LNG.

In offshore areas characterized by large wages and where the water is very shallow, less than 20 meters, the tank 60 and/or the buoyant column 62 portion of the buoyancy system 40 may be flooded so that the weight of the free end of the space frame 20 may be supported by the seabed 102.

In certain locations it may be an advantage to fit the above described system with a vaporiser system for LNG, such that voids may be replaced by vaporised LNG, doing away with the need to import such vapours from an outlying source through submarine pipelines.

While the present system and method has been disclosed according to the preferred embodiment of the invention, those of ordinary skill in the art will understand that other embodiments have also been enabled. Such other embodiments shall fall within the scope and meaning of the appended claims.

What is claimed is:

1. A vessel mooring and fluid transfer system for use with liquid cargo transport vessels, said system comprising:

an extended length space frame having a first end and a second end;

said rigid extended length space frame being supported on said first end by a first column and on said second end by a buoyancy system;

said first column being secured to the seabed;

said buoyancy system being supported by a substantially flat tank;

means for mooring said vessel to said first end of said rigid extended length space frame;

means for changing the azimuth of said rigid extended length space frame at said second end of said rigid extended length space frame;

means for moving fluid to/from said vessel located at said second end of said rigid extended length space frame.

2. The system as defined in claim 1 wherein said means for changing the azimuth of said rigid extended length space frame are thrusters.

3. A vessel mooring and fluid transfer system for use with offshore vessels, said system comprising:

a rigid extended length space frame having a first end and a second end;

said rigid extended length space frame being supported on said first end by a first column and on said second end by a second column;

said first column being secured to the seabed;

said second column being constructed and arranged to rest on said seabed;

means for mooring said vessel to said first end of said rigid extended length space frame;

means for changing the azimuth of said rigid extended length space frame at said second end of said rigid extended length space frame;

means for moving fluid to/from said vessel located at said second end of said rigid extended length space frame.

4. The system as defined in claim 3 wherein said means for changing the azimuth of said rigid extended length space frame includes thrusters.

5. A method for mooring and off-loading fluids from a vessel at an offshore location, said method comprising the steps of:

supporting the first end of an extended length space frame at an offshore location, so that the second end of said extended length space frame moves around said first end of said extended length space frame;

using thrusters located on said second end of said space frame to angularly position said space frame with respect to its first end;

mooring the vessel to the first end of said extended length space frame;

providing a fluid connection to the vessel at said second end of said extended length space frame; and pumping fluid from the vessel through said fluid connection.

* * * * *